US005120470A

United States Patent [19]

Ohmure et al.

[11] Patent Number: 5,120,470

[45] Date of Patent: * Jun. 9, 1992

[54] SOLVENT COMPOSITION COMPRISING A CHLOROPENTAFLUOROPROPANE AND A CHLOROFLUOROETHANE

[75] Inventors: Yukio Ohmure, Takatsuki; Masahiro Noguchi, Moriguchi; Naoyoshi Hanatani, Settsu, all of Japan

[73] Assignee: Daikin Industries, Ltd., Osaka, Japan

[ * ] Notice: The portion of the term of this patent subsequent to Jan. 15, 2008 has been disclaimed.

[21] Appl. No.: 515,731

[22] Filed: Apr. 27, 1990

[30] Foreign Application Priority Data

Apr. 27, 1989 [JP] Japan ..... 1-111273
Apr. 27, 1989 [JP] Japan ..... 1-111274

[51] Int. Cl.[5] ..... C11D 7/50; C11D 7/30; C23G 5/028

[52] U.S. Cl. ..... 252/364; 252/172

[58] Field of Search ..... 252/364, 172, DIG. 9

[56] References Cited

U.S. PATENT DOCUMENTS 4,863,630 9/1989 Swan et al. ..... 252/172 X
4,947,881 8/1990 Magid et al. ..... 134/40
4,961,869 10/1990 Eggers et al. ..... 252/172 X
4,985,168 1/1991 Ohmure et al. ..... 252/67
5,070,113 12/1991 Omure et al. ..... 252/364

FOREIGN PATENT DOCUMENTS 1-132785 5/1989 Japan ..... 252/172
1-132814 5/1989 Japan ..... 252/172
1-136980 5/1989 Japan ..... 252/172
1-136981 5/1989 Japan ..... 252/172
1-136982 5/1989 Japan ..... 252/172
1-139861 6/1989 Japan ..... 252/172
WO90/08814 8/1990 PCT Int'l Appl. .
8912674 12/1989 World Int. Prop. O. ..... 252/172

*Primary Examiner*—John S. Maples
*Assistant Examiner*—Gary L. Geist
*Attorney, Agent, or Firm*—Larson and Taylor

[57] ABSTRACT

The present invention provides:

(1) a solvent composition comprising chloropentafluoropropane and 1,1-dichloro-1-fluoroethane; and (2) a solvent composition comprising chloropentafluoropropane and dichlorotrifluoroethane.

6 Claims, No Drawings

SOLVENT COMPOSITION COMPRISING A CHLOROPENTAFLUOROPROPANE AND A CHLOROFLUOROETHANE

FIELD OF THE INVENTION

This invention relates to a solvent composition.

BACKGROUND OF THE INVENTION

Chlorofluoroethanes such as 1,1,2,2-tetrachloro-1,2-difluoroethane (R-112), 1,1,2-trichloro-1,2,2-trifluoroethane (R-113) and the like have heretofore been used as solvent or detergent. These solvents have various excellent properties: they are nonflammable and low in toxicity to organisms; they can selectively solve fat, grease, wax and the like but do not attack plastics, rubber and like high molecular materials. However, R-113 and some chlorofluorocarbons are recently pointed out to be responsible for the destruction of the ozone layer in the stratosphere. The destruction of ozone layer will exert an adverse influene on the whole ecosystem including mankind. Thus, the use and production of chlorofluorohydrocarbons which may contribute to the destruction of the ozone layer are now restricted under international agreements and it is expected the use and production thereof would be totally banned.

Various compounds and materials have been proposed as solvents which may replace chlorofluorohydrocarbons. However, they have some defects and cannot fully satisfy the requirements as practical solvent. For example, chlorine containing solvents such as 1,1,1-trichloroethane, trichloroethylene, methylene chloride and the like are likely to cause environmental pollution. Alcohols and hydrocarbons are low in detergency and highly inflammable.

SUMMARY OF THE INVENTION

It is the primary object of the present invention to provide new compositions which can replace the conventional chlorofluoroethanes and which have excellent properties as solvent.

Other objects and feature of the invention will become apparent from the following description.

The present invention provides a solvent composition comprising chloropentafluoropropane and 1,1-dichloro-1-fluoroethane (hereinafter referred to as Composition I).

The present invention also provides a solvent composition comprising chloropentafluoropropane and dichlorotrifluoroethane (hereinafter referred to as Composition II).

We conducted extensive research to find a novel solvent composition having a high cleaning power and other properties required of solvent and found that a mixture of chloropentafluoropropane (R-235) and 1,1-dichloro-1-fluoroethane (R-141b) or dichlorotrifluoroethane (R-123) is a good solvent which can substitute the chlorofluorohydrocarbons.

The invention has been accomplished based on these findings.

DETAILED DESCRIPTION OF THE INVENTION

Composition I and Composition II of the invention will be described below in greater detail.

I. Composition I

Chloropentafluoropropane to be used in Composition I can be any of the isomers given below or a mixture of two or more of them.

(1) 1-Chloro-2,2,3,3,3-pentafluoropropane (R-235cb); boiling point = 27° C.

(2) 3-Chloro-1,2,2,3,3-pentafluoropropane (R-235cc); boiling point = 36° C.

(3) 1-Chloro-1,2,2,3-3-pentafluoropropane (R-235ca); boiling point = 44° C.

(4) 1-Chloro-1,1,3,3,3-pentafluoropropane (R-235fa); boiling point = 28° C.

The best result is obtained when R-235cb is used as the chloropentafluoropropane component.

Composition I usually comprises about 90 to about 30% by weight of chloropentafluoropropane (simply referred to as R-235 unless otherwise required) and about 10 to about 70% by weight of R-141b. When the ratio of the two component is within the above range, Composition I can achieve the remarkable effects that it selectively removes dirt such as grease, fat or the like from a substrate made of metal, plastics, rubber, etc. without attacking the substrate itself. In addition, Composition I is totally or substantially nonflammable. If the amount of R-235 in the composition is less than 30% by weight, the composition will be inflammable while use of R-235 in an amount more than 90% by weight reduces detergency of the composition. Of Composition I composed of R-235 and R-141b, a preferred one comprises about 70 to about 40% by weight of the former and about 30 to about 60% by weight of the latter.

Composition I is relatively stable in use under mild conditions. Composition I can contain a stabilizer which will improve chemical stability under severe conditions. Examples of stabilizers are given below.

* Aliphatic nitro compounds such as nitromethane, nitroethane, nitropropane, etc.
* Acetylene alcohols such as 3-methyl-1-butyn-3-ol, 3-methyl-1-pentyn-3-ol, etc.
* Epoxides such as glycidol, methylglycidylether, phenylglycidylether, 1,2-butylene oxide, cyclohexene oxide, epichlorohydrin, etc.
* Ethers such as dimethoxymethane, 1,2-dimethoxyethane, 1,4-dioxane, 1,3,5-trioxane, etc.
* Unsaturated hydrocarbons such as hexene, heptene, octene, 2,4,4-trimethyl-1-pentene, pentadiene octadiene, cyclohexene, cyclopentene, etc.
* Olefinic alcohols such as allyl alcohol, 1-buten-3-ol, 3-methyl-1-buten-3-ol, etc.
* Acrylates such as methyl acrylate, ethyl acrylate, butyl acrylate, etc.
* Phenols such as phenol, trimethylphenol, cyclohexylphenol, thymol, 2,6-di-t-butyl-4-methylphenol, butylhydroxyanisol, isoeugenol, etc.
* Amines such as hexylamine, pentylamine, dipropylamine, diisopropylamine, diisobutylamine, triethylamine, tributylamine, pyridine, N-methylmorpholine, cyclohexylamine, 2,2,6,6-tetramethylpiperazine, N,N'-diallyl-p-phenylenediamine, etc.
* Triazoles such as benzotriazole, 2-(2'-hydroxy-5'-methylphenyl)benzotriazole, chlorobenzotriazole, etc.

These stabilizers are usable singly or at least two of them can be used in mixture. Although variable with the kind of stabilizer, the amount of stabilizer is usually about 0.1 to about 10% by weight, preferably about 0.5 to about 5% by weight, of the total amount of Composition I.

II. Composition II

Chloropentafluoropropanes to be used in Composition II are the same as in Composition I. R-235cb is most preferable also in Composition II.

Dichlorotrifluoroethane to be used in Composition II can be any of the isomers shown below or a mixture of them.

(1) 1,1-dichloro-2,2,2-trifluoroethane (R-123); boiling point=27.5° C.

(2) 1,2-dichloro-1,2,2-trifluoroethane (R-123a); boiling point=28.2° C.

R-123 is preferable to obtain better results.

Composition II usually comprises about 90 to about 20% by weight of R-235 and about 10 to about 80% by weight of dichlorotrifluoroethane (simply referred to as R-123 unless otherwise required). If the amount of R-235 is more than 90% by weight, the cleaning power of the composition is reduced. If the amount of R-123 is over 80% by weight in the composition, the composition will dissolve plastics in a significant amount. Composition II preferably comprises about 70 to about 30% by weight of R-235 and about 30 to about 70% by weight of R-123.

R-235cb and R-123 are similar in boiling point. Thus, Composition II comprising R-235cb and R-123 shows substantially the same ratio of two components after repeated evaporation and condensation steps whatever the initial ratio may be. It is a great merit of Composition II.

Stabilizers as indicated above may be incorporated into Composition II in a similar amount.

R-235, R141b and R-123 are relatively easily decomposable before they reach the ozone layer in the stratosphere and hardly cause the destruction of ozone layer.

The solvent compositions of the invention dissolve away and remove fat, grease, wax, paint, printing ink, etc. from the substrate made of metal, high molecular compound such as plastics, rubber, etc. while hardly attacking the substrate. The composition of the invention are therefore very useful as solvent for eliminating grease and dirt from parts for electronic and electric devices, metal parts, etc., detergent for removing releasing agent from mold, etc.

The compositions of the invention are safe to use because they are nonflammable or hardly inflammable.

EXAMPLES

Given below are examples and comparison examples to clarify the feature of the invention.

EXAMPLES 1 TO 3 AND COMPARISON EXAMPLES 1 TO 2

Solvent compositions comprising R-235cb and R-141b were prepared in the weight ratio given in Table 1 below.

A test piece of wire net (50 mm×50 mm; 50 mesh) stained with spindle oil was immersed in a solvent obtained as above and washed to evaluate the degreasing power of each solvent.

The degreasing was carried out in the following steps.

(1) Immersion in solvent for 1 minute in the first vessel.

(2) Immersion in solvent for 1 minute in the second vessel.

(3) Steam cleaning for 1 minute in the third vessel.

The oil removing rate was determined as an index of degreasing power in accordance with the following formula:

$$\text{Oil removing rate (\%)} = \frac{(A - B)}{A} \times 100$$

wherein A is the amount of spindle oil on the net before cleaning and B is the amount of spindle oil after cleaning.

The results are shown in Table 1.

TABLE 1

| | R-235cb/R-141b | Oil removing rate (%) |
|---|---|---|
| Ex. | | |
| 1 | 80/20 | 99.9 |
| 2 | 60/40 | 100 |
| 3 | 40/60 | 100 |
| Comp. Ex. | | |
| 1 | 100/0 | 65 |
| 2 | 0/100 | 100 |

The results in Table 1 indicate that Compositions I of the invention have a high degreasing power.

EXAMPLES 4 TO 6 AND COMPARISON EXAMPLES 3 TO 5

Using mixtures of R-235cb and R-141b in varying ratios, the influence of solvent of the invention on plastics (weight increase by swelling of the material) was inspected.

Immediately after a test piece of plastics (5 mm×50 mm×2 mm) was immersed and kept in a mixture at 50° C. for 1 hour, the test piece was weighed to find the weight increase. The results are given in Table 2 below.

The plastics used were as follows.

(a) ...polyvinyl chloride (b) ...acrylonitrile-butadiene-styrene copolymer (c) ...polycarbonate (d) ...polypropylene

TABLE 2

| | Ratio | Weight increase (%)* | | | |
|---|---|---|---|---|---|
| | R-235cb/R141b | (a) | (b) | (c) | (d) |
| Ex. | | | | | |
| 4 | 80/20 | A | A | A | A |
| 5 | 60/40 | A | A | A | A |
| 6 | 40/60 | A | B | B | B |
| Comp. Ex. | | | | | |
| 3 | 20/80 | B | C | C | B |
| 4 | 100/0 | A | A | A | A |
| 5 | 0/100 | B | C | C | B |

*A: Increase of less than 3%
B: Increase of 3% to 5%
C: Increase of more than 5%

The results in Table 2 show that Compositions I of the Invention are low in the ability to dissolve plastics.

EXAMPLES 7 TO 9 AND COMPARISON EXAMPLES 6 TO 7

The procedure of Example 1 was followed except that the mixtures of R-235cb and R-123 were used in place of the mixtures of R-235cb and R-141b.

The results are given in Table 3 below.

TABLE 3

| | R-235cb/R-123 | Oil removing rate (%) |
|---|---|---|
| Ex. | | |

TABLE 3-continued

| | R-235cb/R-123 | Oil removing rate (%) |
|---|---|---|
| 7 | 70/30 | 99.9 |
| 8 | 50/50 | 100 |
| 9 | 30/70 | 100 |
| Comp. Ex. | | |
| 6 | 100/0 | 65 |
| 7 | 0/100 | 100 |

The results in Table 3 show that Compositions II of the invention have a good degreasing power.

EXAMPLES 10 TO 12 AND COMPARISON EXAMPLES 8 TO 10

Following the procedure of Example 4 except that the mixtures of R-235cb and R-123 were used in place of the mixtures R-235cb and R-141b, the influence of solvent of the invention on plastics were checked.

Table 4 shows the results.

TABLE 4

| | Ratio | Weight increase (%)* | | | |
|---|---|---|---|---|---|
| | R-235cb/R123 | (a) | (b) | (c) | (d) |
| Ex. | | | | | |
| 10 | 80/20 | A | A | A | A |
| 11 | 60/40 | A | A | A | A |
| 12 | 40/60 | A | B | B | B |
| Comp. Ex. | | | | | |
| 8 | 20/80 | B | — | — | B |
| 9 | 100/0 | A | A | A | A |
| 10 | 0/100 | B | C | C | B |

It is evident that Compositions II of the invention are low in the ability to dissolve plastics.

We claim:

1. A solvent composition comprising chloropentafluoropropane selected from the group consisting of (1) 1-chloro-2,2,3,3,3-pentafluoropropane;
(2) 3-chloro-1,2,2,3,3-pentafluoropropane;
(3) 1-chloro-1,2,2,2,2-pentafluoropropane; and
(4) 1-chloro-1,1,3,3,3,-pentafluoropropane and 1,1-dichloro-1-fluoroethane.

2. A solvent composition according to claim 1 which comprises about 90 to about 30% by weight of said chloropentafluoropropane and about 10 to 70% by weight of 1,1-dichloro-1-fluoroethane.

3. A solvent composition according to claim 2 which comprises about 70 to about 40% by weight of said chloropentafluoropropane and about 30 to 60% by weight of 1,1-dichloro-1-fluoroethane.

4. A solvent composition comprising chloropentafluoropropane selected from the group consisting of (1) 1-chloro-2,2,3,3,3-pentafluoropropane;
(2) 3-chloro-1,2,2,3,3-pentafluoropropane;
(3) 1-chloro-1,2,2,3,3-pentafluoropropane; and
(4) 1-chloro-1,1,3,3,3,-pentafluoropropane and dichlorotrifluoroethane.

5. A solvent composition according to claim 4 which comprises about 90 to about 20% by weight of said chloropentafluoropropane and about 10 to 80% by weight of dichlorotrifluoroethane.

6. A solvent composition according to claim 5 which comprised about 70 to about 30% by weight of chloropentafluoropropane and about 30 to 70% by weight of dichlorotrifluoroethane.

* * * * *